US009954282B2

(12) United States Patent
Abe

(10) Patent No.: US 9,954,282 B2
(45) Date of Patent: Apr. 24, 2018

(54) WAVEGUIDE, SLOTTED ANTENNA AND HORN ANTENNA

(71) Applicant: NIDEC ELESYS CORPORATION, Kawasaki-shi, Kanagawa (JP)

(72) Inventor: Akira Abe, Kawasaki (JP)

(73) Assignee: NIDEC ELESYS CORPORATION, Kanagawa (JP)

( * ) Notice: Subject to any disclaimer, the term of this patent is extended or adjusted under 35 U.S.C. 154(b) by 38 days.

(21) Appl. No.: 15/248,135

(22) Filed: Aug. 26, 2016

(65) Prior Publication Data

US 2017/0062931 A1 Mar. 2, 2017

(30) Foreign Application Priority Data

Aug. 27, 2015 (JP) ..... 2015-168365
Sep. 2, 2015 (JP) ..... 2015-173073
(Continued)

(51) Int. Cl.
*H01Q 5/55* (2015.01)
*H01P 3/12* (2006.01)
(Continued)

(52) U.S. Cl.
CPC ..... *H01Q 5/55* (2015.01); *H01P 3/12* (2013.01); *H01Q 13/02* (2013.01); *H01Q 13/12* (2013.01); *H01Q 21/064* (2013.01)

(58) Field of Classification Search
CPC ..... H01Q 5/55; H01Q 13/02; H01Q 13/12; H01Q 21/064
See application file for complete search history.

(56) References Cited

U.S. PATENT DOCUMENTS 4,786,913 A 11/1988 Barendregt et al.
2012/0229362 A1 9/2012 Abe
2013/0033404 A1* 2/2013 Abe ..... H01Q 13/02 343/776

FOREIGN PATENT DOCUMENTS

JP 2011-193421 A * 9/2011 ..... H01P 3/12
JP 2011-193421 A 9/2011
JP 2012-147105 A 8/2012

OTHER PUBLICATIONS

Abe, A.; "Radar Antenna Unit and Radar Device,"; U.S. Appl. No. 15/248,132, filed Aug. 26, 2016.

* cited by examiner

*Primary Examiner* — Hoang Nguyen
(74) *Attorney, Agent, or Firm* — Keating & Bennett, LLP

(57) ABSTRACT

A waveguide transmitting an electromagnetic wave having an electric field that oscillates in a first direction in a second direction perpendicular to the first direction. The waveguide includes rectangular waveguide portions, and a protruding wall and a retracted wall that connect a rectangular waveguide portion to another rectangular waveguide portion. Each of the rectangular waveguide portions has a tubular shape extending in the second direction, and an inner wall of each rectangular waveguide portion has a rectangular cross section. The rectangular waveguide portions are arranged in the second direction, and inner spaces of the rectangular waveguide portions are connected to each other. The protruding wall extends from one of a pair of side surfaces of the rectangular waveguide portion opposed in a third direction toward the other of the pair of side surfaces, the third direction being perpendicular to the first and second directions.

8 Claims, 10 Drawing Sheets

(30) Foreign Application Priority Data

Sep. 29, 2015 (JP) ..... 2015-191860
Jul. 26, 2016 (JP) ..... 2016-146694

(51) Int. Cl.
*H01Q 13/02* (2006.01)
*H01Q 13/12* (2006.01)
*H01Q 21/06* (2006.01)

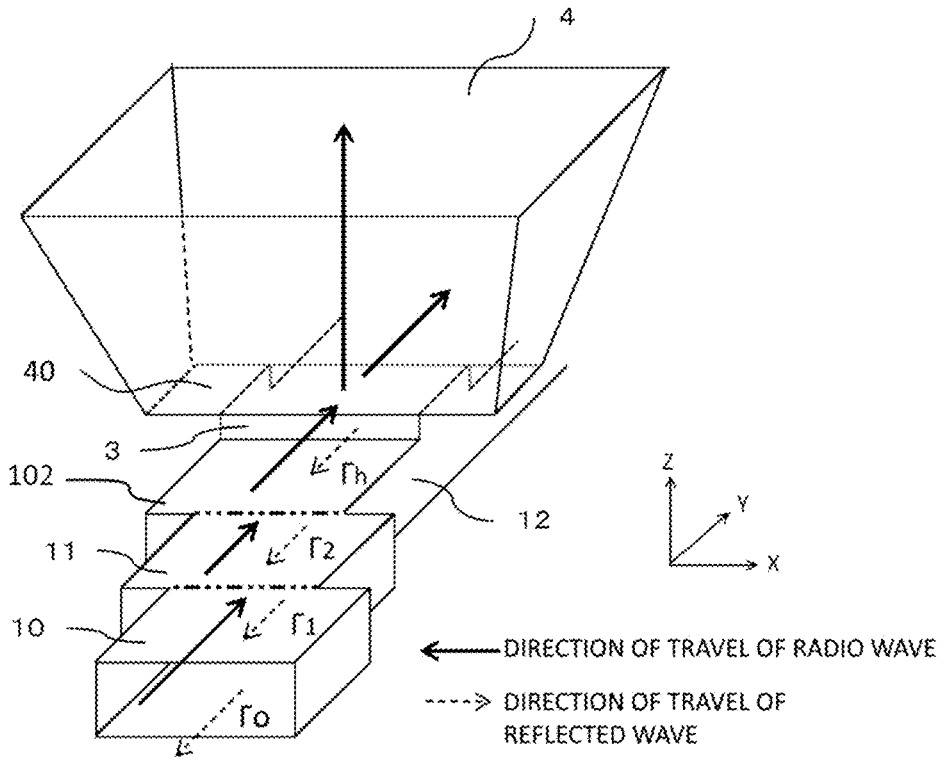
Fig. 4
Fig. 5A
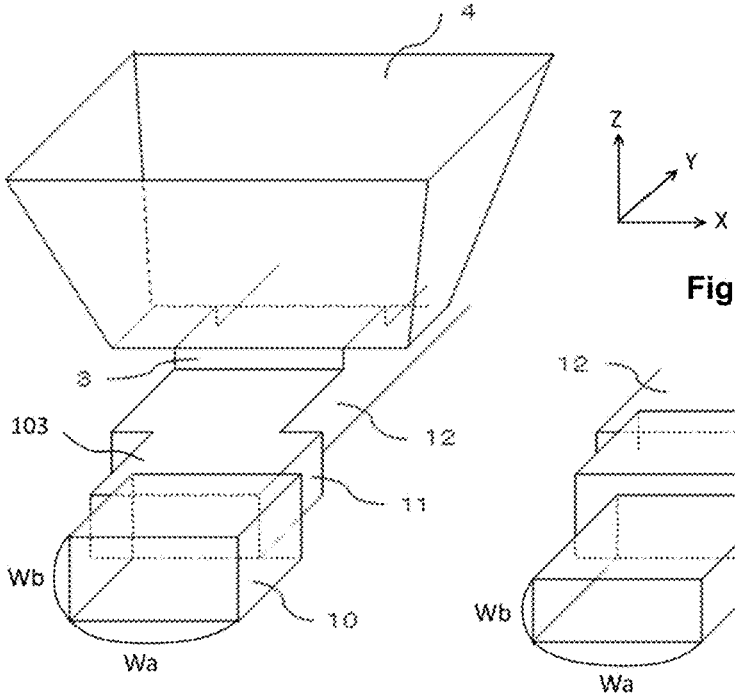
Fig. 5B
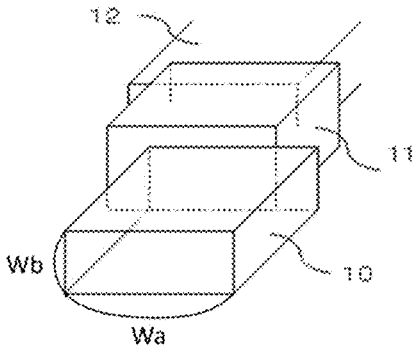

WAVEGUIDE, SLOTTED ANTENNA AND HORN ANTENNA

BACKGROUND OF THE INVENTION

1. Field of the Invention

The present invention relates to a waveguide, a slotted antenna, and a horn antenna preferably for use in a millimeter wave-based onboard radar apparatus, in particular, a digital beam forming (DBF) radar that monitors the direction of travel of an automobile.

2. Description of the Related Art

A DBF radar includes a receiving antenna array composed of a plurality of receiving antenna elements arranged at predetermined intervals (typically, regular intervals) in a scan direction. The DBF radar converts received signals from each receiving antenna element into digital data, performs arithmetic processing on the digital data to impart a phase shift to each received signal, and synthesizes the phase-shifted received signal to generate an equivalent scan beam. The DBF radar can scan at high speed with high precision without the need for any drive part or movable mechanism and therefore is widely used as the onboard millimeter wave radar. However, the DBF radar requires a measure to prevent erroneous detection due to the grating lobe phenomenon.

Japanese Patent Laid-Open No. 2012-147105 discloses a patch antenna unit including transmitting antennas successively displaced and longitudinally symmetrically arranged in a V shape. Side lobes are reduced by using null characteristics of the V-shaped arrangement. However, if the patch antenna is supplied with electric power via a micro-strip line, the dielectric loss is high in the frequency band of the millimeter wave. If a waveguide were used for electric power supply, the loss would be reduced. However, there has not been known any method of supplying electric power to the V-shaped antenna array through a waveguide.

SUMMARY OF THE INVENTION

Preferred embodiments of the present invention provide a waveguide, a slotted antenna, and a horn antenna which supply electric power through a single waveguide to an antenna array at least partially arranged in a V-shape.

A preferred embodiment of the present invention provides a waveguide that transmits an electromagnetic wave having an electric field that oscillates in a first direction, the waveguide transmitting the electromagnetic wave in a second direction perpendicular to the first direction, the waveguide including, at least three rectangular waveguide portions, and a protruding wall and a retracted wall that connect a rectangular waveguide portion to another rectangular waveguide portion, wherein each of the rectangular waveguide portions has a tubular shape extending in the second direction, an inner wall of each rectangular waveguide portion has a rectangular cross section, the rectangular waveguide portions are arranged in the second direction, inner spaces of the at least three rectangular waveguide portions are connected to each other, the protruding wall extends from one of a pair of side surfaces of the rectangular waveguide portion opposed in a third direction toward the other of the pair of side surfaces, and the retracted wall extends from the other of the pair of side surfaces toward the one of the pair of side surfaces, the third direction being perpendicular to both the first direction and the second direction, at least one rectangular waveguide portion of the at least three rectangular waveguide portions includes an inner space having a length within a predetermined range in the second direction, the at least one rectangular waveguide portion being disposed between other two rectangular waveguide portions in the second direction; and the predetermined range is between $(\lambda g-\lambda g/8)/(2n+M)$ and $(\lambda g+\lambda g/8)/(2n+M)$, where n denotes a natural number equal to or greater than 2, and M denotes a natural number excluding 0.

Preferred embodiments of the present invention enables electric power supply to an antenna array that is at least partially arranged in a V shape through a single waveguide.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4 is a diagram showing directions of travel of radio waves in the laterally shifting waveguide according to a preferred embodiment of the present invention with the radiator connected thereto.

FIG. 5A is a perspective view of a laterally shifting waveguide according to a modification example of a preferred embodiment of the present invention.

FIG. 5B is a partial perspective view of the laterally shifting waveguide according to the modification example of a preferred embodiment of the present invention.

DETAILED DESCRIPTION OF THE PREFERRED EMBODIMENTS

Figure 1A:
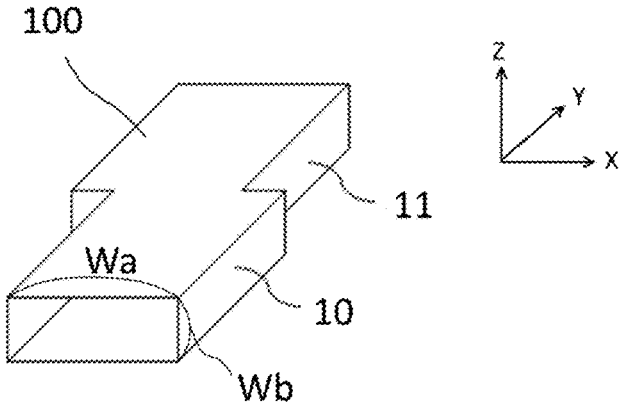
FIG. 1A is a perspective view of a partially laterally shifting waveguide according to a preferred embodiment of the present invention.
Figure 1B:
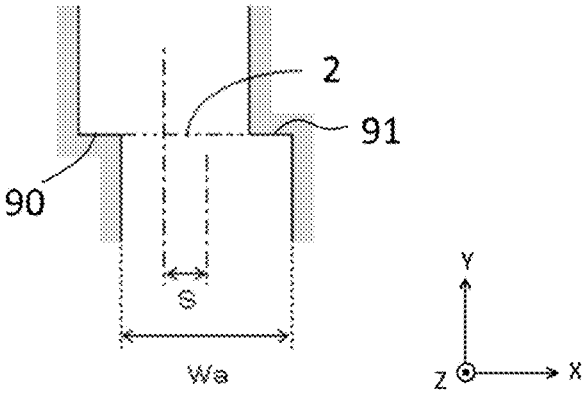
FIG. 1B is a view of the partially laterally shifting waveguide according to a preferred embodiment of the present invention viewed in a Z direction.

FIGS. 1A and 1B show a partially laterally shifting waveguide according to a preferred embodiment of the present invention. A laterally shifting waveguide (waveguide) 100 transmits, in a second direction (Y direction) perpendicular to a first direction (Z direction), an electromagnetic wave having an electric field that oscillates in a first direction. The waveguide 100 has the shape of a straight extending waveguide that is divided by a shifting plane 2 that is perpendicular to an axis of the waveguide. The resulting divisional portions are referred to as a rectangular waveguide portion 10 and a rectangular waveguide portion 11. The rectangular waveguide portions 10 and 11 are connected to each other with the axes thereof kept in parallel with each other and displaced in a third direction (X direction) perpendicular to the Y direction and the Z direction.

Inner spaces of the rectangular waveguide portions 10 and 11 each have a tubular shape extending in the second direction, and each of inner walls of the rectangular waveguide portions has a rectangular cross section. The rectangular waveguide portions 10 and 11 have the same width in the X direction. The positions of the rectangular waveguide portions 10 and 11 in the X direction differ by S, which is smaller than the width of the rectangular waveguide portions 10 and 11.

The rectangular waveguide portions 10 and 11 are preferably connected to each other at the shifting plane 2 with a lateral shift S. The portions of the inner spaces of the rectangular waveguide portions 10 and 11 other than the portions shared by the rectangular waveguide portions 10 and 11 are closed with conductive walls. Conductive walls that close the portions of the inner spaces of the rectangular waveguide portions 10 and 11 other than the portions shared by the rectangular waveguide portions 10 and 11 include a protruding wall 90 and a retracted wall 91, which preferably define a step surface. The protruding wall 90 and the retracted wall 91 connect the rectangular waveguide portion 10 and the rectangular waveguide portion 11 to each other. The protruding wall 90 extends in the +X direction from a −Y-directional end of a −X-directional side surface of a pair of side surfaces of the rectangular waveguide portion 11 opposed in the X direction, and is connected to a +Y-directional end of a −X-directional side surface of the rectangular waveguide portion 10. On the other hand, the retracted wall 91 extends in the +X direction from a −Y-directional end of a +X-directional side surface of the pair of side surfaces of the rectangular waveguide portion 11 opposed in the X direction, and is connected to a +Y-directional end of a +−X-directional side surface of the rectangular waveguide portion 10. In this detailed description, a waveguide of such a structure is referred to as a laterally shifting waveguide. The laterally shifting waveguide is able to supply electric power to an antenna displaced in the width direction (X direction) of the waveguide. However, reflection of the radio wave occurs at the shifting plane. In order to cancel the reflection and achieve a reflection matching condition, an additional structural modification is needed.

For small antennas that use radio waves in the millimeter wave frequency band, a hollow waveguide is preferably manufactured by, for example, carving a rectangular groove in a flat metal plate and covering the flat metal plate with a metal plate. FIG. 1B is a plan view of a waveguide groove manufactured in this method, and the white void portion is the interior of the waveguide.

Figure 6A:
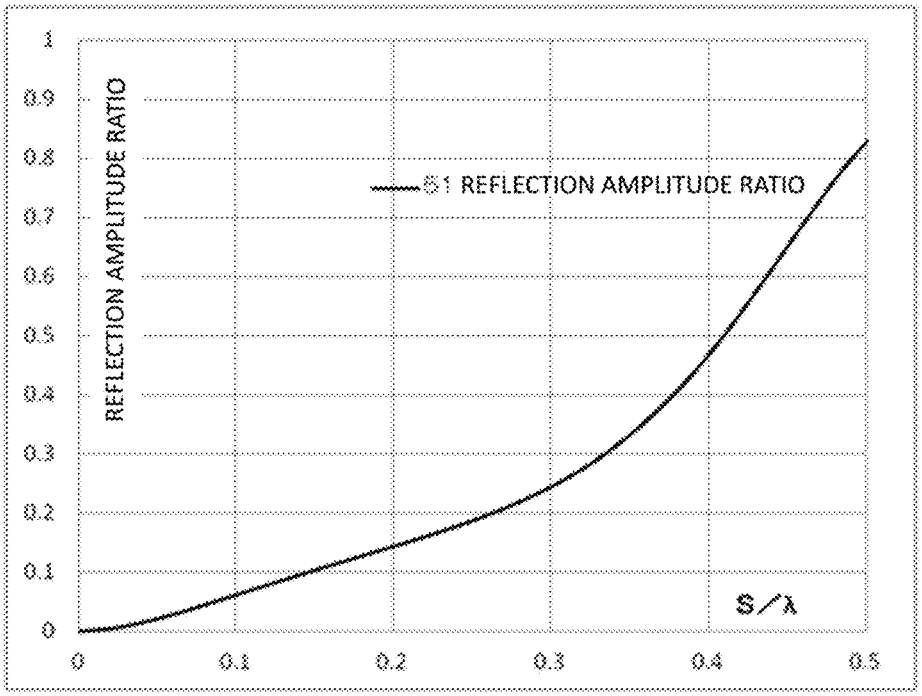
FIG. 6A is a graph showing a reflection amplitude ratio of the laterally shifting waveguide according to a preferred embodiment of the present invention.
Figure 6B:
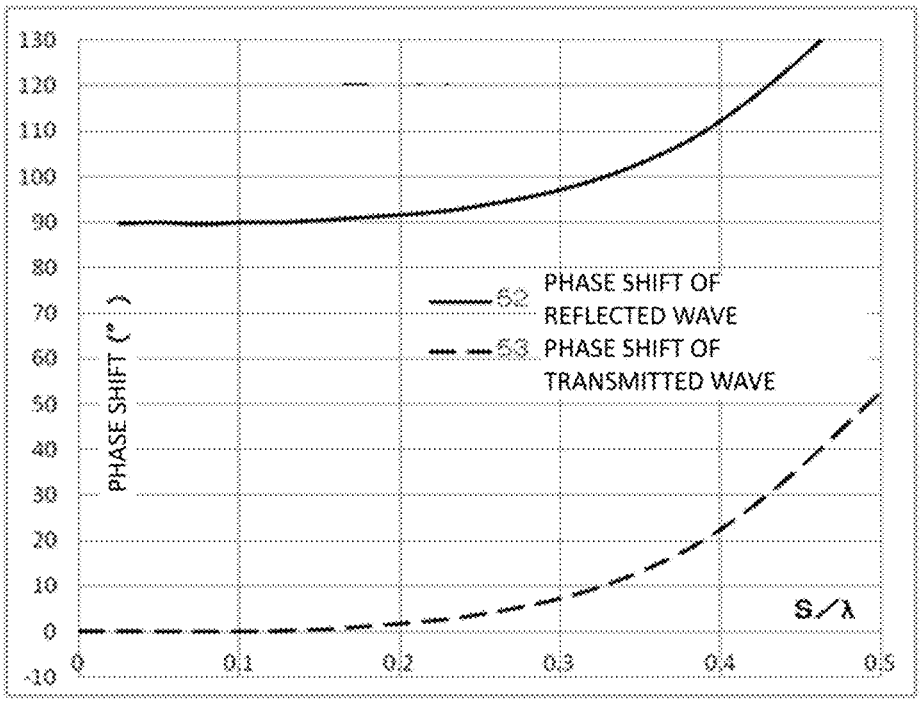
FIG. 6B is a graph showing a phase shift of a reflected wave and a phase shift of a transmitted wave of the laterally shifting waveguide according to a preferred embodiment of the present invention.

FIGS. 6A-6C show response characteristics of the partially laterally shifting waveguide according to preferred embodiments of the present invention. The solid line 51 in FIG. 6A shows a relationship between the lateral shift S of the rectangular waveguide portion and a reflection amplitude ratio (ratio of the magnitude of a reflected electric field to the magnitude of an input electric field). The shift S is normalized with a free space wavelength λ. FIG. 6B shows a relationship between a phase change with respect to a transmitted wave and the normalized shift S. The solid line 52 shows a phase shift of a reflected wave, and the dashed line 53 shows a phase shift of a transmitted wave. Provided that the lengths of the long side and the short side of the rectangular waveguide portion are denoted by Wa and Wb, respectively, the dimensions of the rectangular waveguide are typically selected in the following ranges: $\lambda/2>Wa>\lambda$, and $Wb<\lambda/2$. In this example, the length Wa preferably is set to be about 3.78 mm for the design frequency of about 76.5 GHz and λ of about 3.92 mm. For purposes of computation, the length Wb is preferably set to be about 1 mm. However, the response characteristics do not depend on Wb. Although a phase shift of approximately 90° occurs in the reflected wave, the transmitted wave is substantially in phase with the input wave, and the phase of the transmitted wave does not significantly change as the wave is transmitted through the laterally shifting waveguide.

Figure 2A:
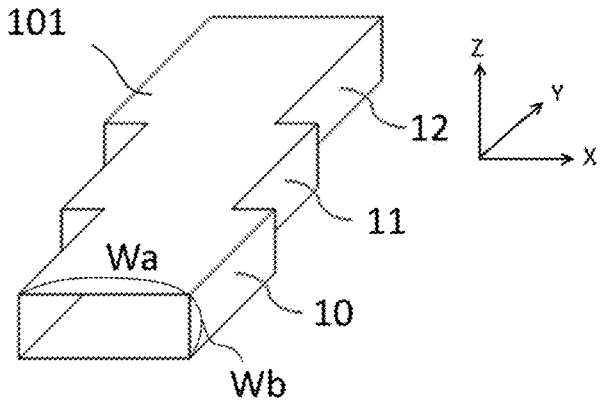
FIG. 2A is a perspective view of a laterally shifting waveguide according to a preferred embodiment of the present invention.
Figure 2B:
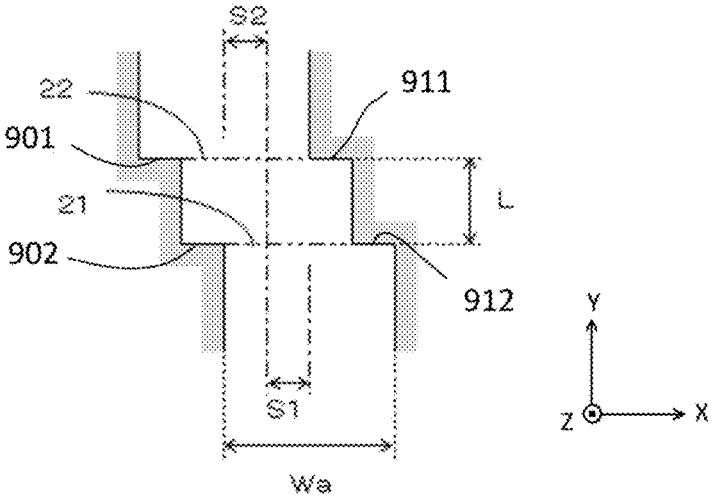
FIG. 2B is a view of the laterally shifting waveguide according to a preferred embodiment of present invention viewed in the Z direction.

FIGS. 2A and 2B show a laterally shifting waveguide 101 according to a preferred embodiment of the present invention. The laterally shifting waveguide shown in FIG. 2A has two shifting planes and therefore referred to as a two-step laterally shifting waveguide. FIG. 2B is a plan view. The laterally shifting waveguide 101 has the structure of the laterally shifting waveguide 100 according to the laterally shifting waveguide 100 shown in the FIG. 1 that includes an additional rectangular waveguide portion 12 in the second direction. The laterally shifting waveguide is preferably provided with two shifting planes 21 and 22. The laterally shifting waveguide is further provided with two protruding walls 901 and 902 and two retracted walls 911 and 912.

The shifts between the rectangular waveguide portion 10 and the rectangular waveguide portion 11 and between the rectangular waveguide portion 11 and the rectangular waveguide portion 12 are denoted as S1 and S2, respectively. The axial length of the rectangular waveguide portion 11, which is the length of the inner space thereof in the second direction, is denoted as L. In this example, the lateral widths Wa in the X direction of the rectangular waveguide portions 10, 11 and 12 are preferably the same. Depending on the design, however, the width Wa may differ between the rectangular waveguide portions. The two-step laterally shifting waveguide 101 is able to achieve reflection matching by itself.

Figure 2C:
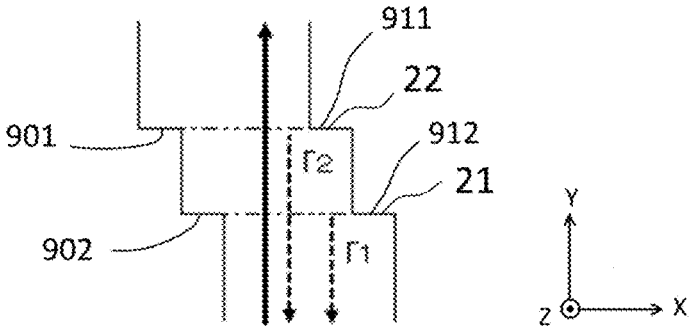
FIG. 2C is a diagram showing directions of travel of radio waves in the laterally shifting waveguide according to a preferred embodiment of the present invention.

In the following, expressions concerning reflection matching will be shown. FIG. 2C schematically shows a flow of a radio wave in the laterally shifting waveguide 101. In FIG. 2C, the solid arrow shows a traveling wave of the radio wave, and the dashed arrows show reflected waves. At the shifting planes 21 and 22, there is a discontinuity in the width direction of the waveguide, so that reflected waves $\Gamma_1$ and $\Gamma_2$ occur, respectively. In the following, the reflected wave is expressed by the following expression.

$$\Gamma=\gamma\cdot\exp(j\varphi+j\rho) \qquad \text{Expression 1}$$

where Γ denotes a complex reflection coefficient, γ denotes a reflection amplitude ratio, ϕ denotes a phase shift of the reflected wave, and ρ denotes a phase difference due to the propagation path length. As required, subscripts indicating portions or the like will be used for identification of the symbols.

To be precise, the influence of multiple reflection and the phase shift of the transmitted wave, which is not reflected but is transmitted by the shifting plane, need to be considered. For approximation, however, these factors are omitted. In addition, it is assumed that the phase shift of the reflected wave is equal or substantially equal to 90° (π/2). With reference to the phase at a midpoint C in the rectangular waveguide portion 11, the reflected waves $\Gamma_1$ and $\Gamma_2$ at the shifting planes 21 and 22 are expressed by the following expressions.

$$\begin{aligned}\Gamma_1 &= \gamma_1\cdot\exp(j\varphi_1 + j\cdot kg\cdot L) \qquad \text{Expression 2}\\ &\approx \gamma_1\cdot\exp\left(\frac{j\pi}{2} + j\cdot kg\cdot L\right)\end{aligned}$$

$$\begin{aligned}\Gamma_2 &= \gamma_2\cdot\exp(j\varphi_2 - j\cdot kg\cdot L) \qquad \text{Expression 3}\\ &\approx \gamma_2\cdot\exp\left(\frac{j\pi}{2} - j\cdot kg\cdot L\right)\end{aligned}$$

In these expressions, λg denotes the guide wavelength in the waveguide, and kg=2π/λg. The italicized letter j denotes an imaginary unit. Provided that the reflected wave of the entire system, that is, the reflection coefficient to the rectangular waveguide portion 10 is denoted as $\Gamma_0$, $\Gamma_0$ is expressed by the following expression.

$$\begin{aligned}\Gamma_0 &= \Gamma_1 + \Gamma_2 \qquad \text{Expression 4}\\ &= j(\gamma_1 + \gamma_2)\cdot\cos(kg\cdot L) - (\gamma_1 - \gamma_2)\cdot\sin(kg\cdot L)\end{aligned}$$

From Expression 4, $\Gamma_0$=0 when $\gamma_1=\gamma_2$, and cos(kg*L)=0. $\gamma_1$ and $\gamma_2$ are proportional to the widths of the retracted walls 911 and 912. Thus, in order for the condition that $\gamma_1=\gamma_2$ to be satisfied, it is required that S1=S2. The condition that cos(kg*L)=0 is satisfied, when L=λg/4 or an odd multiple of λg/4. Thus, these two requirements are conditions required to achieve reflection matching.

Reflection matching is able to be achieved in a laterally shifting waveguide with more steps. A laterally shifting waveguide with n laterally shifted connections is referred to as an n-step laterally shifting waveguide. Provided that all the rectangular waveguide portions 11 to 1(n−1) have the same axial length (=L), and the shifts between the rectangular waveguide portions at laterally shifted connections 21 to **2*n*** are the same (=S), the reflection coefficient of the entire system is expressed by the following expression.

$$\begin{aligned}\Gamma_0 &= j\cdot\gamma_S\cdot\exp(j\cdot kg\cdot L)\cdot\left\{\sum_{i=0}^{n-1}\exp(-2i\cdot j\cdot kg\cdot L)\right\} \qquad \text{Expression 5}\\ &= j\cdot\gamma_S\cdot\exp(j\cdot kg\cdot L)\cdot\frac{\{\exp(-2nj\cdot kg\cdot L)-1\}}{\{\exp(-2j\cdot kg\cdot L)-1\}}\end{aligned}$$

where $\gamma_s$ denotes a reflection amplitude ratio at each retracted wall.

When L=λg/(2n), $\Gamma_0$ expressed by this expression equal to 0, and reflection matching is achieved. That is, when n (equal to or greater than 2) laterally shifted connections are provided, the condition of L to achieve reflection matching is that L=λg/(2n+M) (M denotes a natural number including 0).

Although, L is no need to be equal to λg/(2n+M) strictly. If L is between (λg−λg/8)/(2n+M) and (λg+λg/8)/(2n+M), efficiency of reflection matching is achieved.

If the long side width of a rectangular waveguide portion is equal to or smaller than λ/2, the rectangular waveguide is cut off and cannot transmit the wave. Thus, the lateral width (Wa−S) of the joint between two waveguides at the shifting plane 2 has to be greater than λ/2. Thus, the following expression concerning the shift S is derived.

$$S<W_a-\lambda/2 \qquad \text{Expression 6}$$

If a two-step structure cannot achieve reflection matching, an n-step structure (n>3) can be useful. However, the principle of reflection matching is the same as that for the two-step structure. Thus, in the following, reflection matching of an antenna using the two-step laterally shifting waveguide will be described.

Figure 3A:
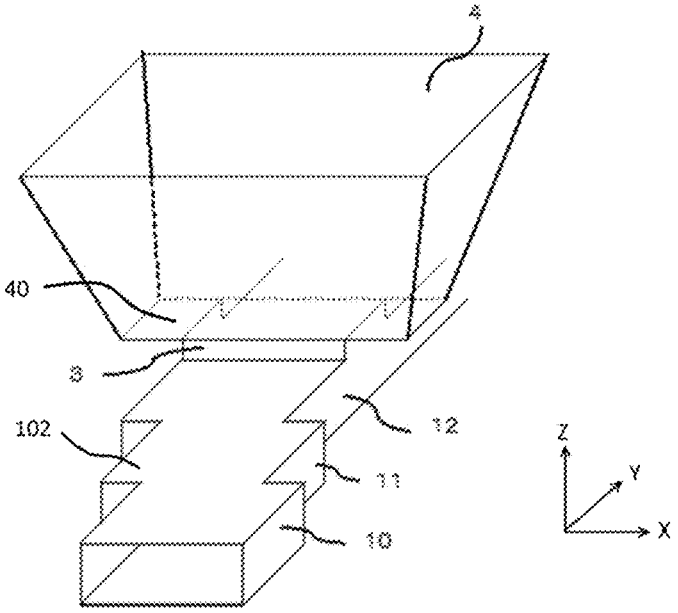
FIG. 3A is a perspective view of the laterally shifting waveguide according to a preferred embodiment of the present invention to which a radiator is connected.
Figure 3B:
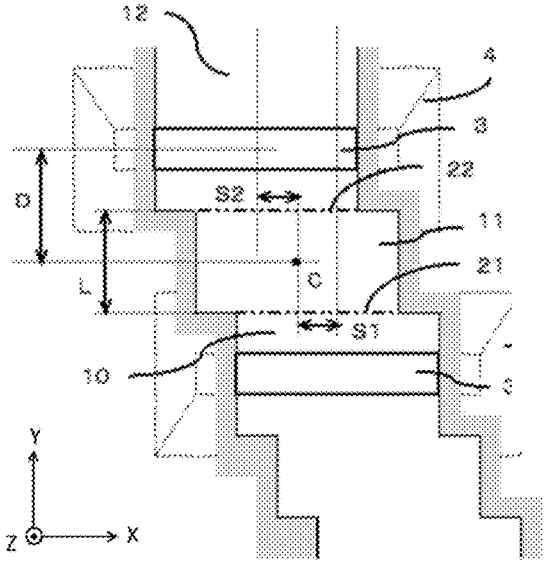
FIG. 3B is a view of the laterally shifting waveguide according to a preferred embodiment of the present invention with the radiator connected thereto viewed in the Z direction.
Figure 3C:
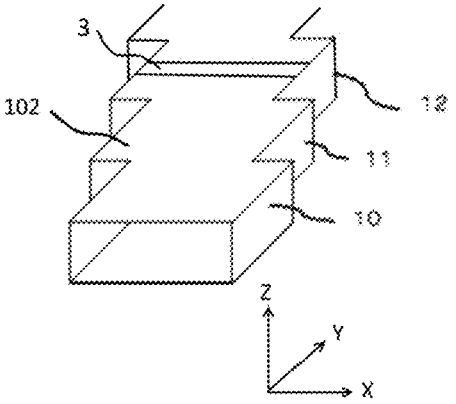
FIG. 3C is a perspective view of the laterally shifting waveguide according to a preferred embodiment of the present invention to which a slot is connected.

FIG. 3C shows a slotted antenna. The slotted antenna preferably includes a laterally shifting waveguide 102 and a rectangular slot 3, which is an opening that penetrates a wall of the rectangular waveguide portion 12 perpendicular to the Z direction. Note that, the slot 3 does not necessarily have the rectangular shape but can have any desirable shape that allows propagation of a radio wave of a wavelength equal to or higher than the cutoff wavelength.

FIG. 3A shows a horn antenna. The horn antenna preferably includes the laterally shifting waveguide 102 and a rectangular horn 4 connected to the laterally shifting waveguide 102. The laterally shifting waveguide 102 includes the slot 3, which is an opening that penetrates a wall of the rectangular waveguide portion 12 perpendicular to the Z direction. Each slot 3 has the shape of a rectangle having long sides extending in the X direction. Each slot 3 opens in a base portion of the corresponding rectangular horn 4, and the long side of the rectangular horn 4 and the long side of the slot 3 extend in the same direction. The rectangular waveguide portions 10, 11, and 12 are connected to each other while being shifted in the X direction. This arrangement is treated as a unit, a plurality of other horn antennas (not shown) are arranged in the Y direction. The slot 3 does not necessarily have the rectangular shape but can have any shape that allows propagation of a radio wave of a wavelength equal to or higher than the cutoff wavelength.

FIG. 3B is a plan view in which illustration of the rectangular horns is omitted. FIG. 3B shows two slots adjacent in the Y direction and three rectangular waveguide portions. To the rectangular waveguide portion 10, the rectangular waveguide portion 11, which is adjacent to the rectangular waveguide portion 10, is connected. This combination is equivalent to the combination of the rectangular waveguide portions 11 and 10 in FIG. 1A. Furthermore, the rectangular waveguide portion 12 is connected to the rectangular waveguide portion 11. The rectangular waveguide portion 10 also includes the slot 3. The axial length of the rectangular waveguide portion 11 is denoted as L, and the axial distance from the midpoint C of the rectangular waveguide portion 11 to a midpoint of the slot 3 is denoted as D. The "axial length (distance)" used herein is used in the same meaning as the "length (distance) in the Y direction".

The rectangular horn 4 preferably includes a flat surface portion 40 that extends from each short side of the slot 3 to the base portion of the rectangular horn 4 in the direction away from the axis of the rectangular horn 4. That is, the horn antenna preferably includes the flat surface portion 40. In this example, the flat surface portion 40 is perpendicular to the axis of the rectangular horn 4. The flat surface portion 40 produces an electric field of the TE30 mode, which is a higher-order mode. Since the electric field of the TE30 mode and the electric field of the TE10 mode, which is the fundamental mode, are combined with each other, the gain of the antenna is able to be increased in a predetermined azimuth.

In FIG. 4, traveling waves and reflected waves of a radio wave are schematically shown by arrows. A radio wave input to the rectangular waveguide portion 10 is transmitted through the rectangular waveguide portion 11 to the rectangular waveguide portion 12. In this process, a portion of the electric power is coupled to the slot 3 and radiated from the rectangular horn 4. The remaining electric power is guided to the subsequent rectangular horns. By repetitions of the same procedure, radio waves are radiated from all the rectangular horns of the antenna. In this process, reflected waves $\Gamma_1$ and $\Gamma_2$ from the shifting planes 21 and 22 and a reflected wave $\Gamma_h$ from the rectangular horn/slot occur. In this system, reflection matching is achieved by using the reflected waves in the laterally shifting waveguide as canceling waves.

Figure 7A:
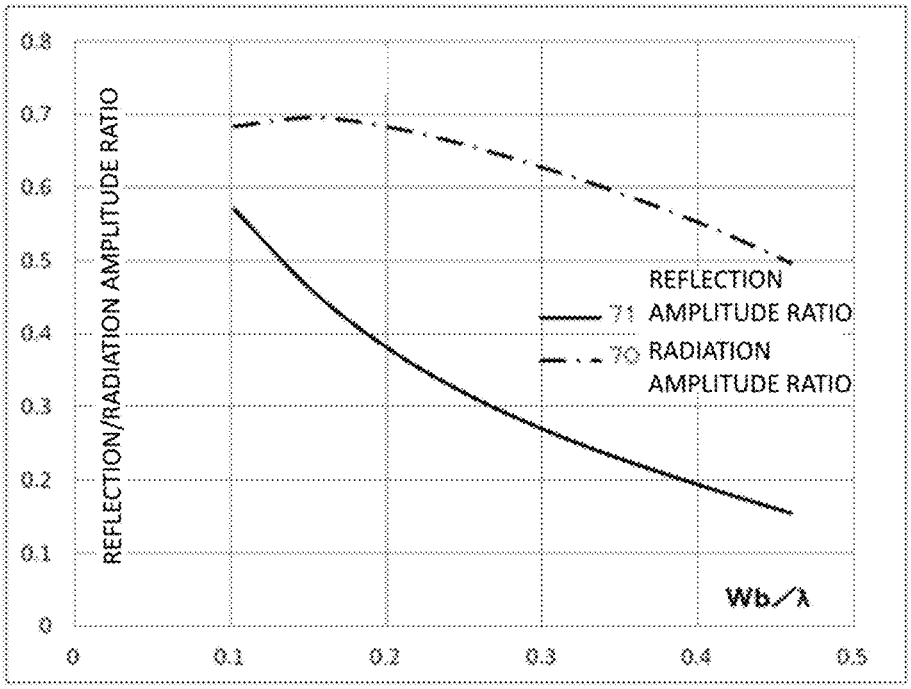
FIG. 7A is a graph showing a reflection amplitude ratio of the radiator (a slot and a horn) according to a preferred embodiment of the present invention.
Figure 7B:
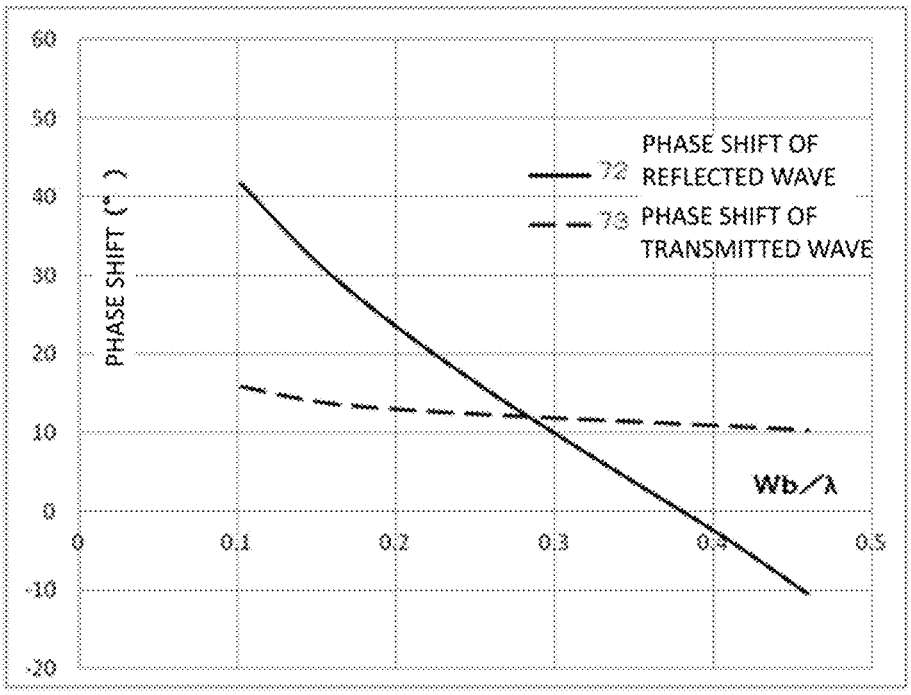
FIG. 7B is a graph showing a phase shift of a reflected wave and a phase shift of a transmitted wave of the radiator (the slot and the horn) according to a preferred embodiment of the present invention.

In the following, an example of a reflection matching design will be derived by reference to expressions. FIGS. 7A and 7B show an example of computational response characteristics of a radiator (a slot and a rectangular horn). In FIG. 7A, the alternate long and short dash line 70 shows a radiation amplitude ratio (the radio of the magnitude of the radiated electric field to the magnitude of the input electric field), and the solid line 71 shows a reflection amplitude ratio in the case where a horn is coupled, via a slot, to a long side surface of a rectangular waveguide that extends straight. The dimension Wa of the long side of the rectangular waveguide portion is fixed, and variations with respect to the dimension Wb of the short side are shown. The horizontal axis shows Wb/λ normalized.

In this example, approximately, in the range of Wb/λ equal to or smaller than 0.2 or substantially 0.2, the radiation amplitude ratio increases as the dimension of the short side decreases. FIG. 7B shows phase changes with respect to the input wave. The solid line 72 shows a phase shift of a reflected wave, and the dashed line 73 shows a phase shift of a transmitted wave. Compared with the solid line 52 in FIG. 6B, the reflected wave of the laterally shifting waveguide has a phase shift of 90° or approximately 90°, although the reflected wave caused by the radiator is in phase or substantially in phase with the input wave in particular in the range of Wb/λ equal to or smaller than 0.2 or about 0.2, for example. Thus, approximately, phase shifts are assumed as follows: $\phi_s=\pi/2$, and $\phi_h=0$. Provided that a composite of the reflected waves of the laterally shifting waveguide is denoted as $\Gamma_w$, $\Gamma_w$ can be determined by substituting $\Gamma_0$ with $\Gamma_w$ in Expression 4. Although there is a requirement that S1=S2 in the case of reflection matching by the two-step laterally shifting waveguide by itself, the requirement is dropped in the case where it is used as a matching element. For the sake of simplicity, however, the case where S1=S2 is shown herein. Then, $\Gamma_w$ is expressed by the following expression.

$$\begin{aligned}\Gamma_W &= \Gamma_1 + \Gamma_2 \\ &= 2j\cdot\gamma_S\cdot\cos(kg\cdot L) \\ &= 2\gamma_S\cdot\cos(kg\cdot L)\cdot\exp\left(\frac{j\pi}{2}\right)\end{aligned} \quad \text{Expression 7}$$

The reflected wave from the radiator is expressed by the following expression.

$$\begin{aligned}\Gamma_h &= \gamma_h\cdot\exp(j\rho_h) \\ &= \gamma_h\cdot\exp(-2j\cdot kg\cdot D)\end{aligned} \quad \text{Expression 8}$$

First, an equal amplitude condition for $\Gamma_w$ and $\Gamma_h$ will be described. The magnitude of $\Gamma_w$ varies with L, and L is determined according to the following expression.

$$2\gamma_s\cdot\cos(kg\cdot L)=\pm\gamma_h \quad \text{Expression 9}$$

where $\gamma_h$ denotes a reflection amplitude ratio of the radiator.

The left side is a positive value when L<λg/4 and is a negative value when λg/4<L<λg/2.

For reflection matching to be achieved in the reflected wave from the radiator, in the case where L<λg/4, the following expression has to be satisfied.

$$-2\cdot kg\cdot D=\frac{\pi}{2}+m\pi \quad \text{Expression 10}$$

where m denotes an odd number.

A condition required for the laterally shifting waveguide to be housed in a vertical spacing λg of the radiator is expressed by the following expression.

$$D=\lambda g/8 \text{ or } 5\lambda g/8$$

Similarly, in the case where λg/4<L<λg/2, the following expression holds.

$$-2\cdot kg\cdot D=-\frac{\pi}{2}+m\pi \quad \text{Expression 11}$$

In this case, D=3λg/8.

Figure 8:
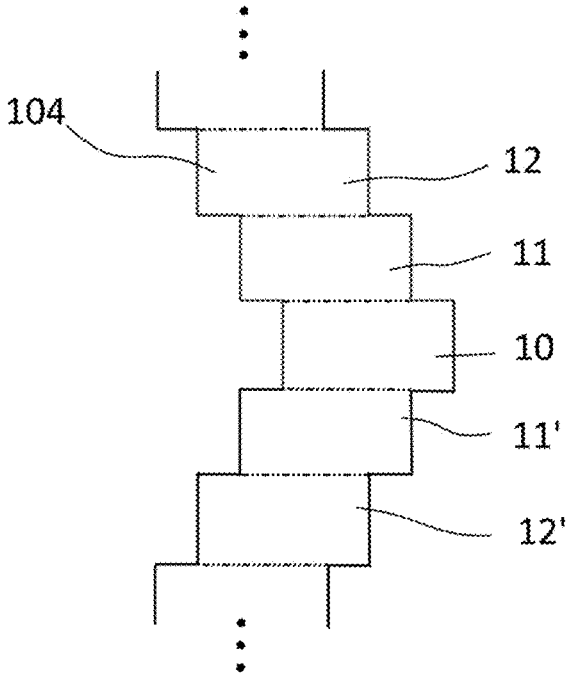
FIG. 8 is a diagram showing an example of an arrangement of rectangular waveguide portions according to a preferred embodiment of the present invention.

FIG. 8 is a plan view showing an example of the arrangement of rectangular waveguide portions viewed in the Z direction.

A plurality of rectangular waveguide portions (10, 11, 12, 11', 12', . . . ) are arranged in the Y direction to define a laterally shifting waveguide 104 that has the shape of a letter V open in the −X direction as a whole. This structure can be formed by at least three rectangular waveguide portions.

It has been described above that to use the two-step laterally shifting waveguide is effective to achieve reflection matching. However, the above description concerns an approximate analysis under a predetermined condition. As a general design method, a direct analysis using a three-dimensional simulator or the like is suitable. Based on the direct analysis, precise design dimensions are able to be determined considering all factors including the influence of multiple reflection without the need to separately analyze the reflection amplitude ratio, the phase shift or the like of each wave. Furthermore, a structure is also possible in which not only the lateral shift but also the dimension Wb of the short side of the rectangular waveguide portion (depth of the groove) can vary.

For example, a traveling-wave array antenna is typically designed so that the radiation amplitude ratio gradually increases from the power supply end toward the distal end, since the electric power in the power supply path decreases each time the radio wave passes through a radiating element. This is able to be achieved by changing dimensions of the slot and the horn. However, in that case, the radiation directivity characteristics also change, and therefore the design becomes more complicated. As an alternative, it is useful to change the dimension of the short side of the rectangular waveguide portion. As shown by the alternate long and short dash line 70 in FIG. 7A, in this example, the radiation amplitude ratio increases as the dimension of the short side decreases in the range of Wb/λ equal to or smaller than 0.2 or about 0.2, for example. Thus, the radiation amplitude ratio is able to be adjusted by gradually reducing the dimension of the short side in this range of Wb/λ. The laterally shifting waveguide can have a structure in which the rectangular waveguide portions are laterally shifted with respect to each other and differ in dimension Wb of the short side, such as the structure of a laterally shifting waveguide 103 shown in FIG. 5A. Since a reflection component due to the discontinuity in dimension Wb of the short side additionally occurs, the reflection amplitude ratio generally increases. However, the principle of reflection matching described above can be equally applied. Although, in Expression 9, the equal amplitude condition may not be satisfied if $2\gamma_s<\gamma_h$, $\gamma_s$ can be increased by changing the dimension Wb of the short side of the rectangular waveguide portion 11 as shown in FIG. 5B, for example.

Figure 9A:
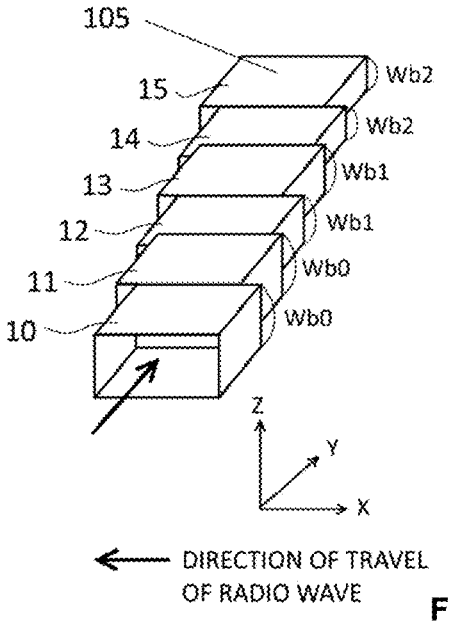
FIG. 9A is a partial perspective view of a laterally shifting waveguide according to a modification example of a preferred embodiment of the present invention.
Figure 9B:
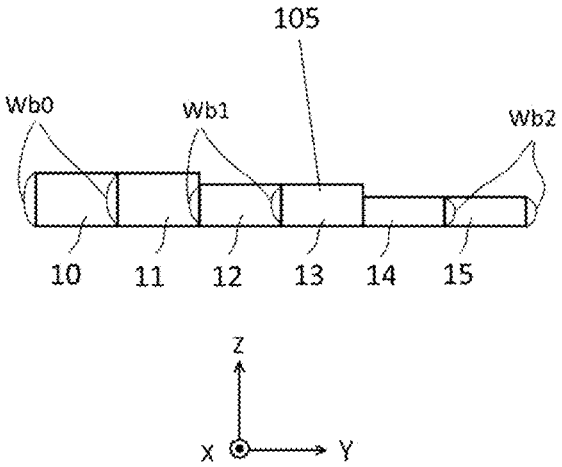
FIG. 9B is a view of the laterally shifting waveguide according to the modification example of a preferred embodiment of the present invention viewed in a X direction.
Figure 9C:
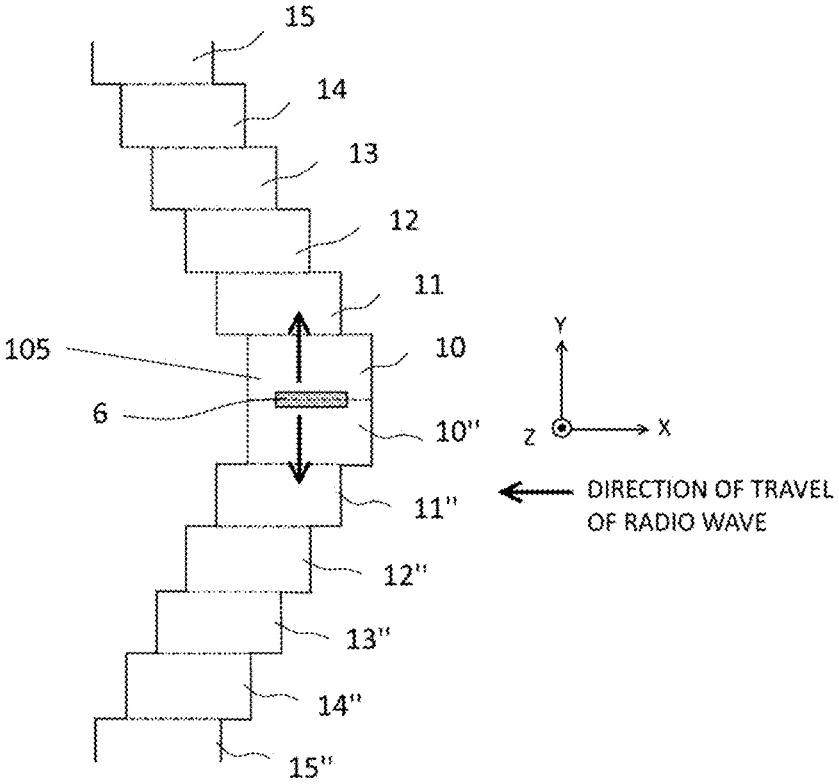
FIG. 9C is a view of the laterally shifting waveguide according to the modification example of a preferred embodiment of the present invention viewed in the Z direction.

FIGS. 9A-9C show a modification example of the laterally shifting waveguide according to a preferred embodiment of the present invention. FIG. 9A is a partial perspective view of a laterally shifting waveguide 105, and FIG. 9B is a view of the laterally shifting waveguide 105 viewed in the X direction. FIG. 9C is a view of the laterally shifting waveguide 105 viewed in the Z direction. Provided that the dimension of the short side of rectangular waveguide portions 10 and 11 is denoted by Wb0, the dimension of the short side of rectangular waveguide portions 12 and 13 is denoted by Wb1, and the dimension of the short side of rectangular waveguide portions 14 and 15 is denoted by Wb2, a relation holds: Wb0>Wb1>Wb2. As shown in FIGS. 9A and 9B, the rectangular waveguide portions are preferably arranged stepwise in such a manner that the dimension of the short side of the rectangular waveguide portion gradually decreases from the power supply end to the distal end.

Furthermore, rectangular waveguide portions 10", 11", 12", 13", 14" and 15" are connected in the −Y direction. A power supply opening 6 is provided between the rectangular waveguide portions 10 and 10". As shown in FIG. 9C, the laterally shifting waveguide 105 has the shape of a letter V open in the −X direction as a whole. When the dimension of the short side of rectangular waveguide portions 10" and 11" is Wb0, the dimension of the short side of rectangular waveguide portions 12" and 13" is Wb1, and the dimension of the short side of rectangular waveguide portions 14" and 15" is Wb2, the relation holds: Wb0>Wb1>Wb2. The rectangular waveguide portions 10", 11", 12", 13", 14" and 15" are also arranged in such a manner that the dimension of the short side of the rectangular waveguide portion gradually decreases from the power supply end to the distal end.

Figure 10A:
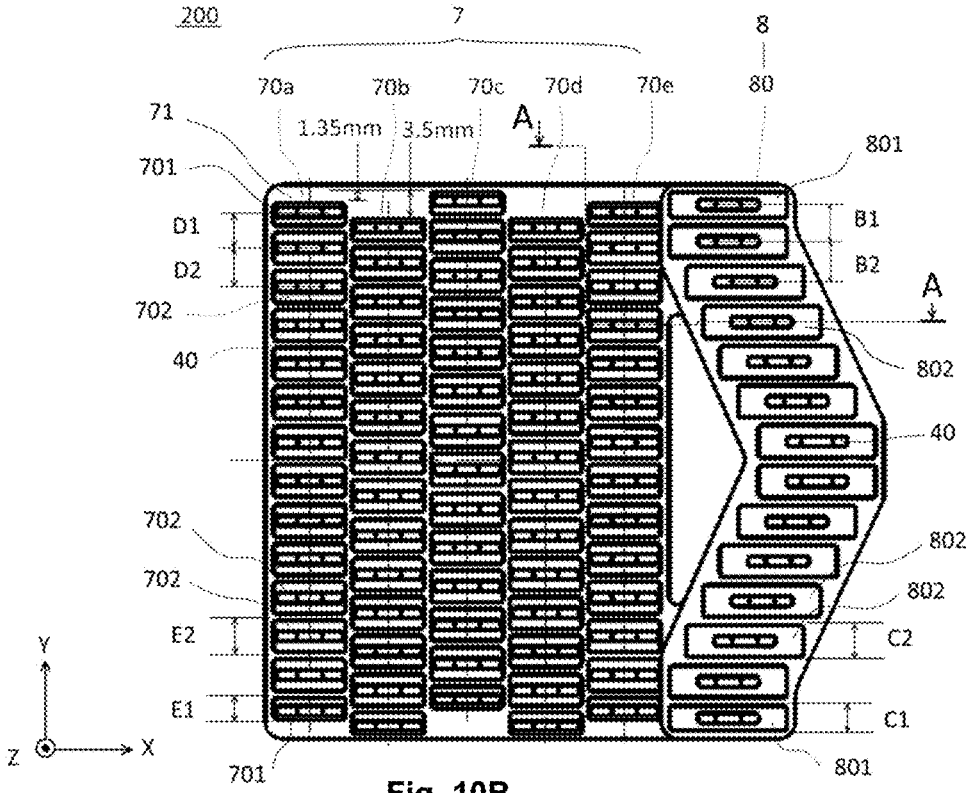
FIG. 10A is a view of an antenna device incorporating the laterally shifting waveguide according to a preferred embodiment of the present invention viewed in the Z direction.
Figure 10B:
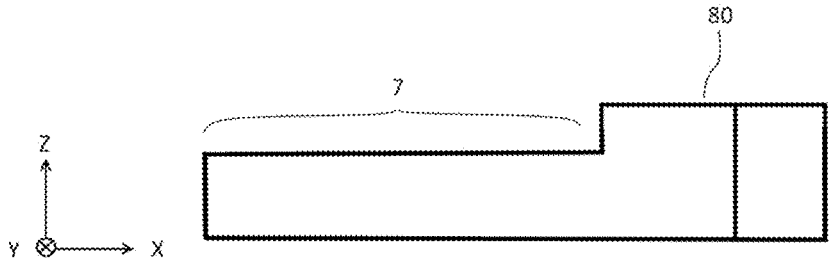
FIG. 10B is a view of the antenna device incorporating the laterally shifting waveguide according to a preferred embodiment of the present invention viewed in the Y direction.
Figure 10C:
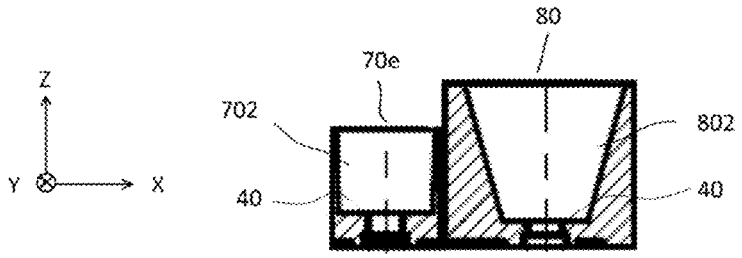
FIG. 10C is a cross-sectional view of the antenna device according to a preferred embodiment of the present invention taken along the line A-A in FIG. 10A.

FIGS. 10A-10C show an antenna device 200 incorporating the laterally shifting waveguide 105. FIG. 10A is a view of the antenna device 200 viewed in the Z direction. The antenna device 200 preferably includes a transmitting portion 8 that transmits a radio wave and a receiving portion 7 that receives a radio wave. The transmitting portion 8 preferably includes one transmitting antenna array 80, and the transmitting antenna array 80 incorporates the laterally shifting waveguide 105 shown in FIG. 9C as a waveguide and fourteen transmitting horns. In FIGS. 10A-10C, the laterally shifting waveguide 105 is not shown, because the laterally shifting waveguide 105 is disposed on the side opposite to the transmitting horns. The transmitting antenna array 80 has the shape of a letter V open in the −X direction as a whole.

Of the preferably fourteen transmitting horns, twelve transmitting horns 802 excluding transmitting horns 801 located at the opposite ends in the Y direction are arranged at regular intervals in the Y direction. A pitch B1 between the transmitting horn 801 at either end in the Y direction and the adjacent transmitting horn 802 is smaller than a pitch B2 between adjacent two of the inner twelve transmitting horns. A dimension C1 in the Y direction of the transmitting horns 801 at the opposite ends is smaller than a dimension C2 in the Y direction of the inner twelve transmitting horns 802.

FIG. 10B is a view of the antenna device 200 viewed in the −Y direction. FIG. 10C is a cross-sectional view of the antenna device 200 taken along the line A-A in FIG. 10A. In FIGS. 10B and 10C, illustration of the waveguide is omitted. Each transmitting horn 802 defining the transmitting antenna array 80 has a greater width in the X direction than each receiving horn 71. As can be seen from FIGS. 10B and 10C, the transmitting antenna array 80 has a greater height dimension in the Z direction than the receiving portion 7. Each of the transmitting horns and the receiving horns preferably includes the flat surface portion 40 at a base portion thereof.

The receiving portion 7 is disposed at the open side of the letter V defined by the transmitting antenna array 80. The receiving portion 7 is an antenna array preferably defined by five receiving antenna subarrays 70*a*, 70*b*, 70*c*, 70*d* and 70*e*. Each receiving antenna subarray preferably includes a rectangular waveguide portion and fourteen receiving horns 71. The rectangular waveguide portion is not shown because the rectangular waveguide portion is disposed on the side opposite to the receiving horns 71. Each receiving antenna subarray extends in the Y direction, and the receiving horns 71 are arranged at regular intervals in the Y direction. The five receiving antenna subarrays are also arranged at regular intervals in the X direction. In the Y direction, the five receiving antenna subarrays are preferably disposed at at least three different positions. More specifically, the five receiving antenna subarrays are preferably arranged as follows. With reference to the receiving antenna subarray 70*c* located at the middle, the receiving antenna subarrays 70*b* and 70*d* adjacent to the receiving antenna subarray 70*c* are disposed at positions shifted by about 3.15 mm in the −Y direction, for example. The receiving antenna subarrays 70*a* and 70*e* located on the outer side of the receiving antenna subarrays 70*b* and 70*d* in the X direction in the receiving portion 7 are disposed at positions shifted by about 1.35 mm, for example, in the −Y direction with reference to the receiving antenna subarray 70*c* located at the middle.

Of the preferably fourteen receiving horns of each of the five receiving antenna subarrays 70*a*, 70*b*, 70*c*, 70*d* and 70*e*, twelve receiving horns 702 excluding receiving horns 701 located at the opposite ends in the Y direction are arranged at regular intervals in the Y direction. A pitch D1 between the receiving horn 701 at either end in the Y direction and the adjacent receiving horn 702 is preferably smaller than a pitch D2 between adjacent two of the inner twelve receiving horns. A dimension E1 in the Y direction of the receiving horns 701 at the opposite ends is preferably smaller than a dimension E2 in the Y direction of the inner twelve receiving horns 702.

Figure 11:
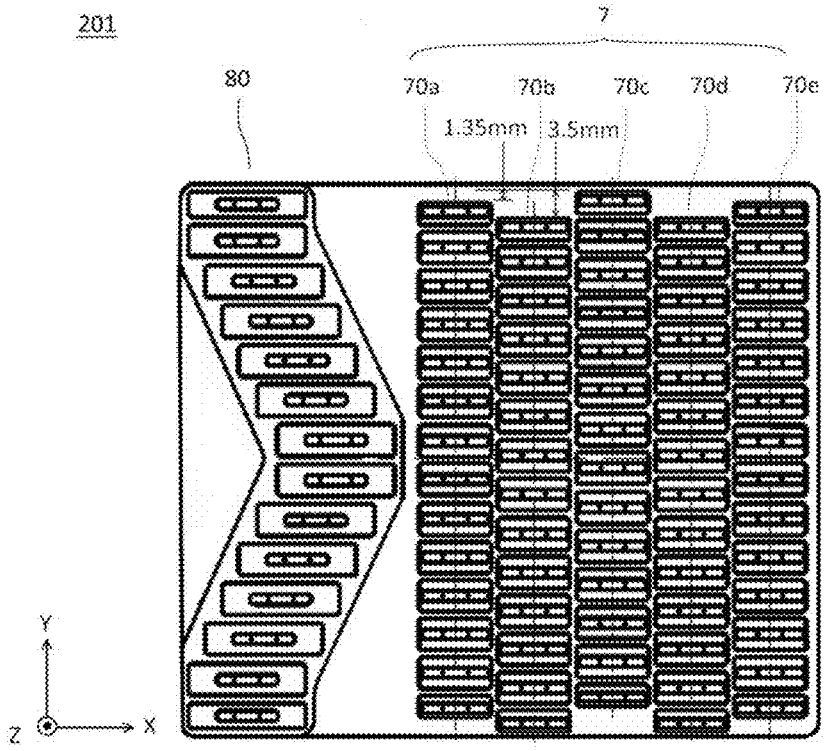
FIG. 11 is a view of an antenna device incorporating the laterally shifting waveguide according to a modification example of a preferred embodiment of the present invention viewed in the Z direction.

FIG. 11 shows a modification example of the antenna device incorporating the laterally shifting waveguide 105. An antenna device 201 differs from the antenna device 200 in that the receiving portion 7 is disposed at the apex side of the letter V formed by the transmitting antenna array 80. The remainder, including the dimensions thereof, is the same as that of the antenna device 200.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A waveguide to transmit an electromagnetic wave having an electric field that oscillates in a first direction, the waveguide transmitting the electromagnetic wave in a second direction perpendicular to the first direction, the waveguide comprising:

at least three rectangular waveguide portions; and a protruding wall and a retracted wall that connect one of the at least three rectangular waveguide portions to another one of the at least three rectangular waveguide portions; wherein each of the at least three rectangular waveguide portions has a tubular shape extending in the second direction;

an inner wall of each of the at least three rectangular waveguide portions has a rectangular cross section;

the at least three rectangular waveguide portions are arranged in the second direction;

inner spaces of the at least three rectangular waveguide portions are connected to each other;

the protruding wall extends from one of a pair of side surfaces of one of the at least three rectangular waveguide portions opposed in a third direction toward the other of the pair of side surfaces, and the retracted wall extends from the other of the pair of side surfaces toward the one of the pair of side surfaces, the third direction being perpendicular to both the first direction and the second direction;

at least one of the least three rectangular waveguide portions includes an inner space having a length within a predetermined range in the second direction, the at least one of the at least three rectangular waveguide portions being disposed between another two of the at least three rectangular waveguide portions in the second direction; and the predetermined range is between $(\lambda g-\lambda g/8)/(2n+M)$ and $(\lambda g+\lambda g/8)/(2n+M)$, where n denotes a natural number equal to or greater than 2, and M denotes a natural number including 0.

2. The waveguide according to claim 1, wherein the at least three rectangular waveguide portions are arranged in the shape of a letter V open in the third direction.

3. A slotted antenna, comprising:

a waveguide according to claim 2; wherein at least one of the at least three rectangular waveguide portions includes a rectangular slot that is an opening that penetrates a wall thereof perpendicular to the first direction.

4. A horn antenna, comprising:

a waveguide according to claim 2; and a plurality of rectangular horns connected to the waveguide; wherein at least one of the plurality of rectangular waveguide portions includes a rectangular slot that is an opening that penetrates a wall thereof perpendicular to the first direction;

each rectangular slot opens into a base portion of a corresponding one of the plurality of rectangular horns; and a long side of the plurality of rectangular horns and a long side of the rectangular slot extend in a same direction.

5. The horn antenna according to claim 4, further comprising:

a flat surface portion that extends from a short side of the rectangular slot to the base portion of the rectangular horn in a direction away from an axis of the rectangular horn; wherein the flat surface portion is perpendicular to the axis of the rectangular horn.

6. A slotted antenna, comprising:

a waveguide according to claim 1; wherein at least one of the at least three rectangular waveguide portions includes a rectangular slot that is an opening that penetrates a wall thereof perpendicular to the first direction.

7. A horn antenna, comprising:

a waveguide according to claim 1; and a plurality of rectangular horns connected to the waveguide; wherein at least one of the plurality of rectangular waveguide portions includes a rectangular slot that is an opening that penetrates a wall thereof perpendicular to the first direction;

each rectangular slot opens into a base portion of a corresponding one of the plurality of rectangular horns; and a long side of the plurality of rectangular horns and a long side of the rectangular slot extend in a same direction.

8. The horn antenna according to claim 7, further comprising:

a flat surface portion that extends from a short side of the rectangular slot to the base portion of the rectangular horn in a direction away from an axis of the rectangular horn; wherein the flat surface portion is perpendicular to the axis of the rectangular horn.

* * * * *